United States Patent [19]

Luukkonen

[11] Patent Number: 5,027,959

[45] Date of Patent: Jul. 2, 1991

[54] RACK ARRANGEMENT

[76] Inventor: Irja Luukkonen, Kyntömiehentie 18, Orimattila, Finland

[21] Appl. No.: 496,630

[22] Filed: Mar. 21, 1990

[30] Foreign Application Priority Data

Apr. 6, 1989 [FI] Finland ..... 891642

[51] Int. Cl.[5] ..... A47F 5/00

[52] U.S. Cl. ..... 211/186; 211/181; 211/187

[58] Field of Search ..... 211/181, 187, 90, 182, 211/186; 108/111; 403/231, 405.1, 171

[56] References Cited

U.S. PATENT DOCUMENTS

| | | | |
|---|---|---|---|
| 2,919,816 | 1/1960 | Maslow | 211/182 X |
| 3,316,864 | 5/1967 | Maslow | 211/181 X |
| 3,589,746 | 6/1971 | Inglis | 211/187 X |
| 4,493,425 | 1/1985 | Yoshida | 211/182 X |
| 4,735,325 | 4/1988 | Remmers | 211/90 X |

FOREIGN PATENT DOCUMENTS

| | | | |
|---|---|---|---|
| 3506542 | 9/1986 | Fed. Rep. of Germany | 211/181 |
| 441565 | 10/1085 | Norway . | |
| 400167 | 3/1978 | Norway . | |

*Primary Examiner*—Robert W. Gibson, Jr.
*Attorney, Agent, or Firm*—Merchant & Gould

[57] ABSTRACT

A rack arrangement or the like, comprising at least two vertical planes (1) which are mainly rectangular in shape and include vertical corner poles (2) and horizontal support bars (3) in between them; at least one horizontal plane (4) which is made of metal wire mesh and arranged to be joined at the heads to the vertical planes, and is provided with lengthwise side bars (5) and transversal head bars (6) in between the side bars; and fastening members (7) in order to couple the horizontal plane to the vertical planes. The fastening member (7) comprises a first gripping member (8) for attaching the fastening member (7) detachably to the vertical plane (1), and a second gripping member (9) for attaching the horizontal plane (4) detachably to the fastening member.

9 Claims, 2 Drawing Sheets

Figure 1:
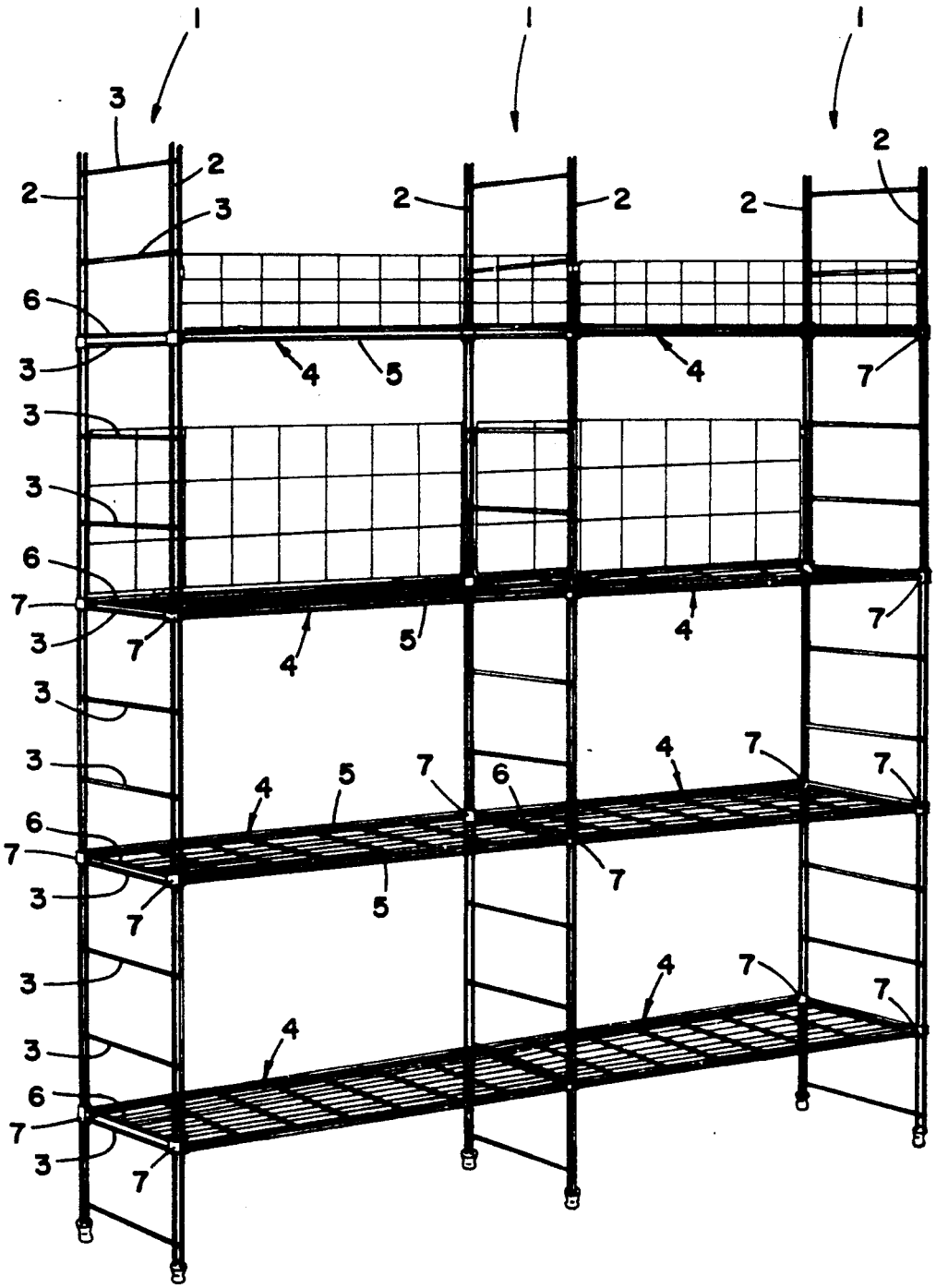

FIG. 2
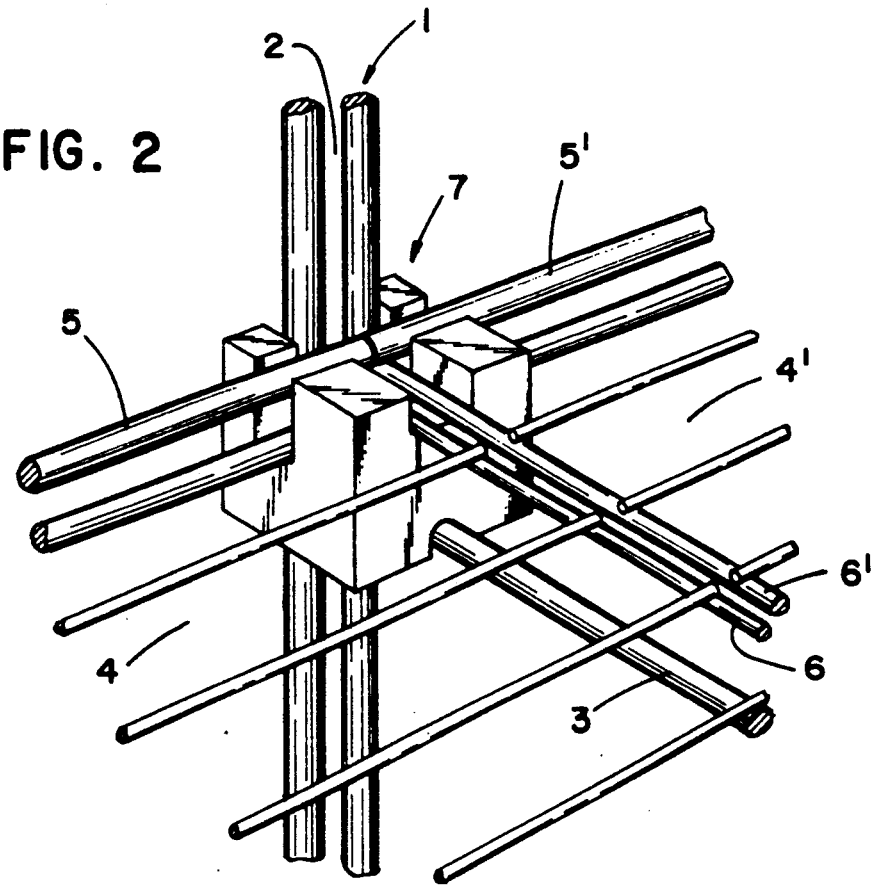
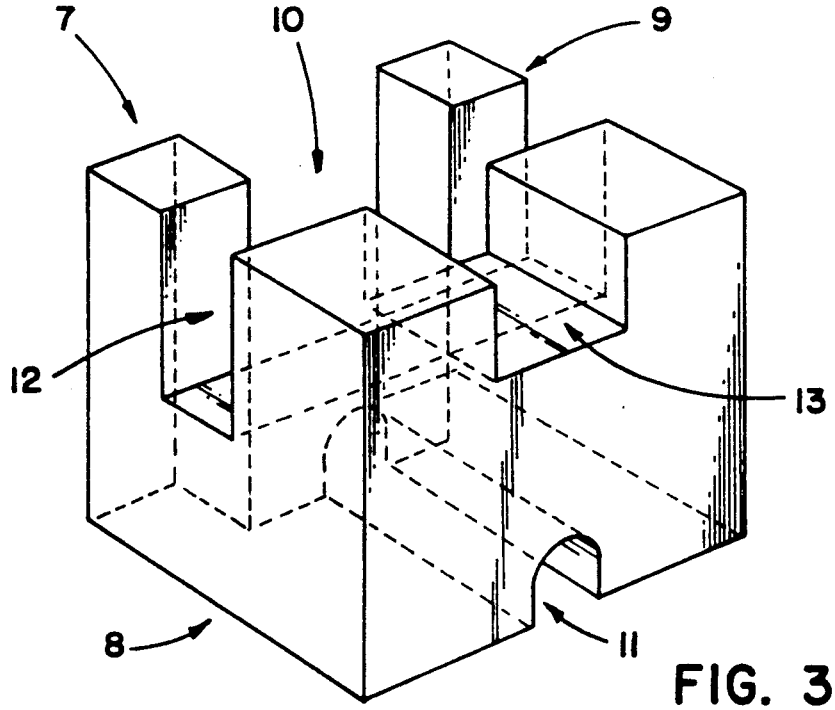
FIG. 3

RACK ARRANGEMENT

The present invention relates to a rack arrangement defined in the introductory section of patent claim 1.

The rack arrangements according to the said introduction are popular for storing goods for instance in shops, storehouses, homes etc.

A problem with the rack arrangements of the said type is that they are difficult to assemble and erect. With these rack arrangements, there are normally used various fastening members, such as screws, studs etc., or the vertical and horizontal planes are welded together.

Another drawback with the rack arrangements of the prior art is that the use of conventional fastening means is difficult, because special tools are often needed.

The use of welded joints is easy and quick from the point of view of production, but the transport and storage of welded rack arrangements takes up a lot of space and is extremely cumbersome.

The object of the present invention is to eliminate the above mentioned drawbacks.

As for the characteristic novel features of the invention, the appended patent claims are referred to.

According to the invention, the fastening member includes a first gripping member for attaching the fastening member detachably to a vertical plane, and a second gripping member for attaching a horizontal plane detachably to the fastening member. The first gripping member fixes the fastening member firmly to the vertical plane, and the second gripping member fixes the horizontal plane firmly to the fastening member, which leads to a solid and unwobbly interconnection of the vertical and horizontal planes. By means of the fastening members provided with gripping members, the rack arrangement is easily erected and dismantled.

In a preferred embodiment of the rack arrangement, the first gripping member is provided with a vertical, sidewards and outwards open groove, which is arranged to fasten the fastening member to the corner pole, and a downwards open bottom groove, which is adjusted to attach the fastening member to the support of the supporting bar. The fastening member is attached at the juncture of the corner pole and the support bar. The lengths of the vertical and bottom grooves are advantageously adjusted so that the fastening member is firmly supported against the respective length of the corner pole and the support bar. The widths of the vertical and bottom grooves are essentially equal to those of the corner pole and the support bar.

In another preferred embodiment of the rack arrangement, the second gripping member is provided with an upwards open lengthwise groove, which is adjusted to attach the side bar to the support of the fastening member, and an upwards open transversal groove which is adjusted to attach the head bar to the support of the fastening member. The meeting point of the side bar and the head bar is fastened to the lengthwise and the transversal groove. The lengths of the lengthwise and transversal grooves are advantageously adjusted so that the fastening member firmly supports the respective lengths of the side bar and the end bar. The widths of the lengthwise and transversal grooves are essentially equal to those of the side bar and the end bar.

In a preferred embodiment of the rack arrangement, the first gripping member and/or the second gripping member are arranged to form a bayonet catch, such as a clasp lock joint, in order to lock the vertical and/or horizontal plane firmly to the fastening member. With a clasp lock joint, it is advantageous to make us of the flexibility of the material of the fastening member in order to create a "snapping" snap lock joint.

In another preferred embodiment of the rack arrangement, the fastening member comprises one single piece of homogeneous material, where the first gripping member and the second gripping member are formed.

In yet another preferred embodiment of the invention, the fastening member is made of strong plastic.

A particular advantage of the invention is that according to it, there can be created a rack arrangement compiled of separate vertical and horizontal planes, which can be fastened together in an easy and simple fashion, for example so that the height of the shelf planes, i.e. the horizontal planes, can be adjusted according to the requirements of their practical use.

Another advantage of the invention is that in order to fasten the vertical and horizontal planes of the rack arrangement together, there are needed no special tools such as screwdrivers, adjustable wrenches or the like.

Moreover, the invention makes it possible to transport, store and sell the rack arrangement in elements which do not take up much space, and then to erect it quickly and easily.

The invention is explained below in more detail with reference to the appended drawing, where FIG. 1 illustrates a preferred embodiment of the invention, seen at an oblique angle from the side;

FIG. 2 illustrates the juncture of the vertical and horizontal planes of the rack arrangement of FIG. 1, seen at an oblique angle from the top, in enlarged size; and FIG. 3 illustrates the fastening member of FIG. 2 separately and even more enlarged.

The rack arrangement or the like illustrated in FIG. 1 comprises a number of vertical planes 1, which are rectangular in shape and include vertical corner poles 2, and in between the said poles, horizontal support bars 3. The rack arrangement further comprises several horizontal planes 4, which are made of metal wire mesh and are designed to be coupled at the heads to the vertical planes 1. The horizontal plane 4 includes lengthwise side bars 5 and transversal head bars 6 in between the side bars. Moreover, the rack arrangement comprises fastening members 7 for connecting the horizontal planes 4 to the vertical planes 1. The fastening members 7 are arranged to support the horizontal plane wherever it meets the vertical plane 1.

It is apparent from FIGS. 2 and 3 that, according to the invention, the fastening member 7 includes a first gripping member 8 for attaching the fastening member detachably to the vertical plane 1, and a second gripping member 9 for attaching the horizontal plane 4 detachably to the fastening member.

The first gripping member 8, formed at the side and underneath the fastening member comprises a sideways and outwards open vertical groove 10, which is arranged to attach the fastening member 7 to the corner pole 2, and a downwards open bottom groove 11, which is arranged to attach the fastening member 7 to the support of the support bar 3. The fastening member 7 is supported against the corner pole 2 and the support bar 4 at their juncture.

The second gripping member 9 formed on the top side of the fastening member 7, comprises an upwards open lengthwise groove 12 which is arranged to attach the side bar 5 to the support of the fastening member 7. Furthermore, the second gripping member 9 comprises an upwards open transversal groove 13 which is arranged to attach the head bar 6 to the support of the fastening member 7.

In FIG. 2, the fastening member 7 attaches two successive horizontal planes 4 to one and the same vertical plane. Thus the lengthwise groove 12 and the transversal groove 13 of the second gripping member 9 of the fastening member 7 are advantageously arranged to attach the side bar 5 and the head bar 6 of each of the successive horizontal planes to one and the same groove.

The grooves 10, 11, 12 and 13 are advantageously arranged, by means of a tight fit, to match the corner pole 2, the support bar 3, the side bar 5 and the head bar 6 to be fastened thereto.

In FIG. 3, the procession of the grooves is illustrated by means of dotted lines in those sections that are not visible in the perspective drawing.

In FIG. 2, the fastening member 7 attaches two successive horizontal planes 4 and 4' to one and the same vertical plane 1. Thus the lengthwise groove 12 and the transversal groove 13 of the second gripping member 9 of the fastening member 7 are advantageously arranged to attach the side bars 5, 5' and the head bars 6, 6' of each of the successive horizontal planes 4 and 4' to one and the same groove.

The first gripping member 8 and the second gripping member 9 are advantageously arranged to form a bayonet catch, such as a snap lock joint, in order to press the vertical plane 1 and the horizontal plane 4 in contact with the fastening member 7. Thus there are not needed any special tools in erecting the rack arrangement.

The fastening member 7 is made of one uniform plastic piece, where the first gripping member 8 and the second gripping member 9 are formed.

The invention is not limited to the above described preferred embodiments exclusively, but many modifications are possible without departing from the inventional idea defined in the appended patent claims.

I claim:

1. A rack arrangement, comprising at least two vertical planes which are mainly rectangular in shape and include vertical corner poles and horizontal support bars in between them; at least one horizontal plane which is made of metal wire mesh and is provided with lengthwise side bars and transversal head bars in between the side bars, said metal wire mesh being arranged to be joined at the heads to the vertical planes; and fastening members in order to couple the horizontal plane to the vertical planes, characterized in that the fastening member comprises a first gripping member for attaching the fastening member detachably to the vertical plane, and a second gripping member for attaching the horizontal plane detachably to the fastening member; said first gripping member being provided with a sideways and outwards open vertical groove which is arranged to attach the fastening member to the corner pole, and a downwards open bottom groove, which is arranged to attach the fastening member to the support of the support bar.

2. A rack arrangement, comprising at least two vertical planes which are mainly rectangular in shape and include vertical corner poles and horizontal support bars in between them; at least one horizontal plane which is made of metal wire mesh and is provided with lengthwise side bars and transversal head bars in between the side bars, said metal wire mesh being arranged to be joined at the heads to the vertical planes; and fastening members for coupling the horizontal plane to the vertical planes, characterized in that the fastening member comprises a first gripping member for attaching the fastening member detachably to the vertical plane, and a second gripping member for attaching the horizontal plane detachably to the fastening member; said second gripping member being provided with an upwards open lengthwise groove, which is arranged to attach the side bar to the support of the fastening member; and said second gripping member being provided with an upwards open transversal groove, which is arranged to fasten the head bar to the support of the fastening member.

3. A rack arrangement, comprising at least two vertical planes which are mainly rectangular in shape and include vertical corner poles and horizontal support bars in between them; at least one horizontal plane which is made of metal wire mesh and is provided with lengthwise side bars and transversal head bars in between the side bars, said metal wire mesh being arranged to be joined at the heads to the vertical planes; and fastening members for coupling the horizontal to the vertical planes, characterized in that the fastening member comprises a first gripping member for attaching the fastening member detachably to the vertical plane, and a second gripping member for attaching the horizontal plane detachably to the fastening member; at least one said gripping member being arranged to form a bayonet catch in order to press the plane associated with said one gripping member in contact with the fastening member.

4. The rack arrangement of claim 1, characterized in that the fastening member is formed of one piece made of uniform material, where the first gripping member and the second gripping member are formed.

5. The rack arrangement of claim 4, characterized in that the fastening members made of strong plastic.

6. The rack arrangement of claim 2, characterized in that the fastening member is formed of one piece made of uniform material, where the first gripping member and the second gripping member are formed.

7. The rack arrangement of claim 6, characterized in that the fastening member is made of strong plastic.

8. The rack arrangement of claim 3, characterized in that the fastening member is formed of one piece made of uniform material, where the first gripping member and the second gripping member are formed.

9. The rack arrangement of claim 8, characterized in that the fastening member is made of strong plastic.

* * * * *